US008408403B2

(12) United States Patent
Hedstrom et al.

(10) Patent No.: US 8,408,403 B2
(45) Date of Patent: Apr. 2, 2013

(54) MOLDED PLASTIC DISHWASHER RACK TINE MEMBERS INCLUDING ELASTOMERIC BUMPERS

(75) Inventors: Kristen K. Hedstrom, Orlando, FL (US); Michael J. Kramer, Atlanta, GA (US); Seungwon (Chris) Song, Jackson, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 1405 days.

(21) Appl. No.: 11/157,967

(22) Filed: Jun. 22, 2005

(65) Prior Publication Data

US 2006/0289038 A1 Dec. 28, 2006

(51) Int. Cl.
*A47G 19/08* (2006.01)

(52) U.S. Cl. ..... 211/41.8; 211/41.5; 211/181.1

(58) Field of Classification Search ..... 211/41.5, 211/41.4, 41.8, 41.9, 126.9, 133.2, 133.5, 211/181.1, 90.03, 132.1, 41.1, 41.2, 41.14, 211/184, 175, 195; 220/487, 488, 655, 732, 220/743, 486, 485, 493
See application file for complete search history.

(56) References Cited

U.S. PATENT DOCUMENTS

| | | | | | |
|---|---|---|---|---|---|
| 1,853,888 | A | * | 4/1932 | Williams | 211/41.1 |
| 2,424,475 | A | | 7/1947 | Madan | |
| 2,946,453 | A | * | 7/1960 | Pityo | 211/41.14 |
| 3,141,552 | A | | 7/1964 | Ettlinger, Jr. | |
| 3,217,890 | A | | 11/1965 | Maslow | |
| 3,245,548 | A | | 4/1966 | Kesilman et al. | |
| 3,252,582 | A | | 5/1966 | Kesilman et al. | |
| 3,266,632 | A | | 8/1966 | Maslow | |
| 3,306,463 | A | | 2/1967 | Maslow | |
| 3,442,397 | A | | 5/1969 | Jaffee et al. | |
| 3,800,957 | A | | 4/1974 | Krause | |
| 4,046,261 | A | * | 9/1977 | Yake | 211/41.8 |
| 4,572,379 | A | * | 2/1986 | Wallo | 211/57.1 |
| 5,195,643 | A | * | 3/1993 | Rocco | 211/59.2 |
| 5,205,419 | A | * | 4/1993 | Purtilo | 211/41.8 |
| 5,351,837 | A | | 10/1994 | Smith | |
| 5,480,035 | A | * | 1/1996 | Smith | 211/41.8 |
| 5,507,399 | A | * | 4/1996 | Hermanson | 211/181.1 |
| 5,601,195 | A | * | 2/1997 | Finola et al. | 211/41.8 |
| 5,605,236 | A | | 2/1997 | Welch | |
| 5,649,630 | A | * | 7/1997 | Remmler | 211/41.8 |
| 5,730,301 | A | | 3/1998 | Welch et al. | |
| 5,787,911 | A | | 8/1998 | Jacobus et al. | |
| 6,364,131 | B1 | * | 4/2002 | Moylan | 211/41.9 |
| 6,571,965 | B1 | * | 6/2003 | Beck et al. | 211/41.8 |
| 6,605,329 | B2 | * | 8/2003 | Bulters et al. | 428/64.1 |
| 6,685,034 | B1 | * | 2/2004 | Cooke | 211/40 |
| 6,726,031 | B2 | | 4/2004 | Laupan | |
| 6,778,089 | B2 | * | 8/2004 | Yoakum | 340/572.8 |
| 6,848,585 | B2 | * | 2/2005 | VanLandingham | 211/41.9 |
| 7,018,281 | B2 | * | 3/2006 | Yahav | 451/439 |
| 7,434,592 | B2 | * | 10/2008 | Larson et al. | 135/73 |
| 2003/0032825 | A1 | * | 2/2003 | Gaige et al. | 554/121 |

* cited by examiner

*Primary Examiner* — Jennifer E. Novosad
(74) *Attorney, Agent, or Firm* — Jacquelyn R. Lin; Diederiks & Whitelaw PLC

(57) ABSTRACT

A dish support rack for a dishwasher is formed from composite, preferably ceramic/plastic composite. The dish rack includes front, rear and opposing side walls interconnected with a bottom portion. The dish support rack includes a plurality of tine members. The tine members include a base member from which extend a plurality of tines. Each base member includes a socket and a pin element used to join individual tine members to form tine rows. The tine rows are then fastened to the bottom portion to establish dish support zones in the dish rack. The tines can include one or more elastomeric bumpers positioned at various locations where dishware is likely to contact.

15 Claims, 4 Drawing Sheets

MOLDED PLASTIC DISHWASHER RACK TINE MEMBERS INCLUDING ELASTOMERIC BUMPERS

BACKGROUND OF THE INVENTION

1. Field of the Invention

The present invention pertains to the art of dishwashers and, more particularly, to a dishwasher dish support rack formed from plastic, including a plurality of tine elements having elastomeric bumpers for cushioning dishware placed on the dish support rack.

2. Discussion of the Prior Art

Most domestic dishwashers include two dish racks to support items to be washed such as dishware, glassware, kitchen utensils, pots pans and the like. Typically, the two dish racks include an upper dish rack positioned near a top portion of the dishwasher, and a lower dish rack arranged below the upper rack. The upper dish rack is used to support glassware, utensils and other small items, while the lower dish rack is used to support larger items, such as dinner plates and baking pans. The dish racks are typically formed from several, discrete, lengths of wire, welded together and then covered with a rubber or plastic coating. In some cases, the dish racks are formed with a plurality of vertically projecting tines that help support and organize the items placed on the dish rack.

Forming a dish rack from plastic in a minimal number of manufacturing steps, while still preserving the various attributes of wire coated racks, would provide significant advantages in workability, versatility of design and cost efficiency. To this end, there exists a need for a dishwasher dish support rack which is formed from plastic, while exhibiting elastomeric qualities to protect delicate dishes and the like.

SUMMARY OF THE INVENTION

The present invention is directed to a dish support rack for a dishwasher. More specifically, the dish support rack is formed from ceramic/plastic composite members that define an outer frame and a bottom surface. The outer frame includes front, rear and opposing side walls that are joined at respective corner portions. The bottom surface includes a plurality of bottom members that extend between, and interconnect with, the front, rear and opposing side walls respectively.

In accordance with a preferred embodiment of the present invention, the dish support rack includes a plurality of tine members, with each tine member including a base member and a plurality of tines that extend substantially perpendicularly from the base member. Each of the plurality of tine members is provided with a pin and a socket element, arranged on opposite ends of the base member, that enable multiple tine members to be joined into a tine row. The tine members are mounted to the dish support rack either singly or in multiple tine rows to form a dish support zone. In accordance with the most preferred embodiment of the present invention, each of the plurality of tines include an elastomeric bumper. The elastomeric bumper is preferably provided both at a terminal tip portion of each tine, as well as at a point where each tine joins the base member. Preferably, the elastomeric bumpers are over molded onto the ceramic/plastic composite members.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
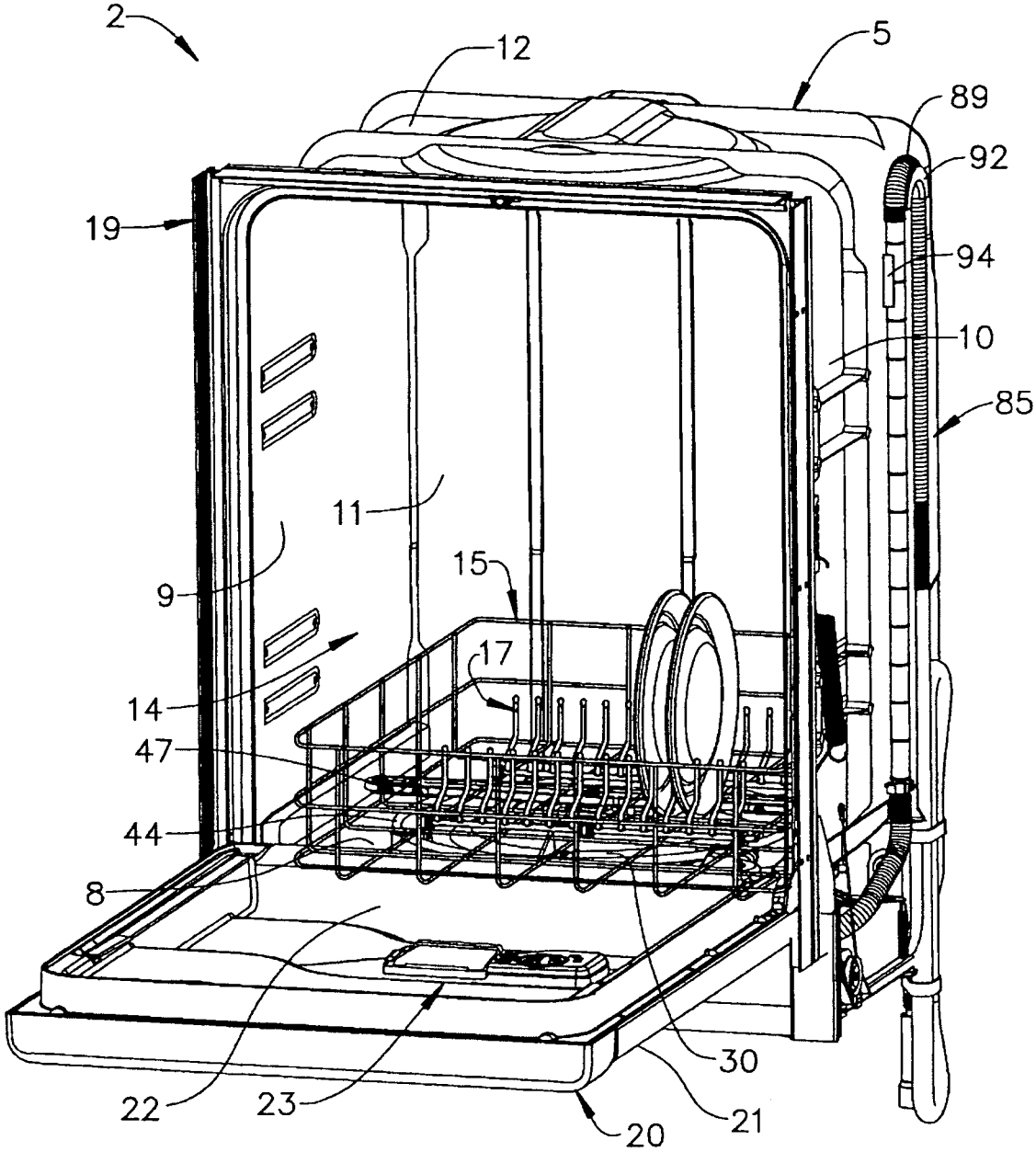
FIG. 1 is a perspective view of a dishwasher incorporating a dish support rack constructed in accordance with the present invention.

With initial reference to FIG. 1, a dishwasher constructed in accordance with the present invention as generally indicated at 2. As shown, dishwasher 2 includes a tub 5 which is preferably injection molded of plastic so as to include integral bottom, side, rear and top walls 8-12 respectively. Within the confines of walls 8-12, tub 5 defines a washing chamber 14 within which soiled kitchenware is adapted to be placed upon an upper dish support rack (not shown) and a lower dish support rack 15, with the kitchenware being cleaned during a washing operation in a manner widely known in the art. Towards that end, lower dish support rack 15 is provided with a plurality of tine rows, two of which are indicated at 17 and 18 (see FIG. 2). Tub 5 has associated therewith a frontal portion 19 at which is pivotally supported a door 20 used to seal washing chamber 14 during the washing operation. Door 20 has an exterior panel 21 and an interior panel 22 preferably provided with a dispensing assembly 23 within which a consumer can place liquid or particulate washing detergent for dispensing at predetermined periods of the washing operation.

Disposed within tub 5 and, more specifically, mounted within a central opening formed in bottom wall 8 of tub 5, is a pump and filter assembly 30. Extending about a substantial portion of pump and filter assembly 30, at a position raised above bottom wall 8, is a heating element 44. In a manner known in the art, heating element 44 preferably takes the form of a sheathed, electric resistance-type heating element. In general, pump and filter assembly 30 is adapted to direct washing fluid to a lower wash arm 47 and an upper wash arm (not shown). Dishwasher 2 has associated therewith a drain hose 85 including at least one corrugated or otherwise curved portion 89 that extends about an arcuate hanger 92 provided on an outside surface of side wall 10. Drain hose 85 is also preferably secured to tub 5 through various clips, such as that indicated at 94. In any event, in this manner, an upper loop is maintained in drain hose 85 to assure proper drainage in a manner known in the art. Actually, a detailed description of the exact structure and operation of pump and filter assembly 30 of dishwasher 2 does not form part of the present invention, but is rather set forth in pending U.S. application Ser. No. 10/186,739 entitled "Dishwasher Pump and Filtration System" filed Jul. 2, 2002, incorporated herein by reference.

Figure 2:
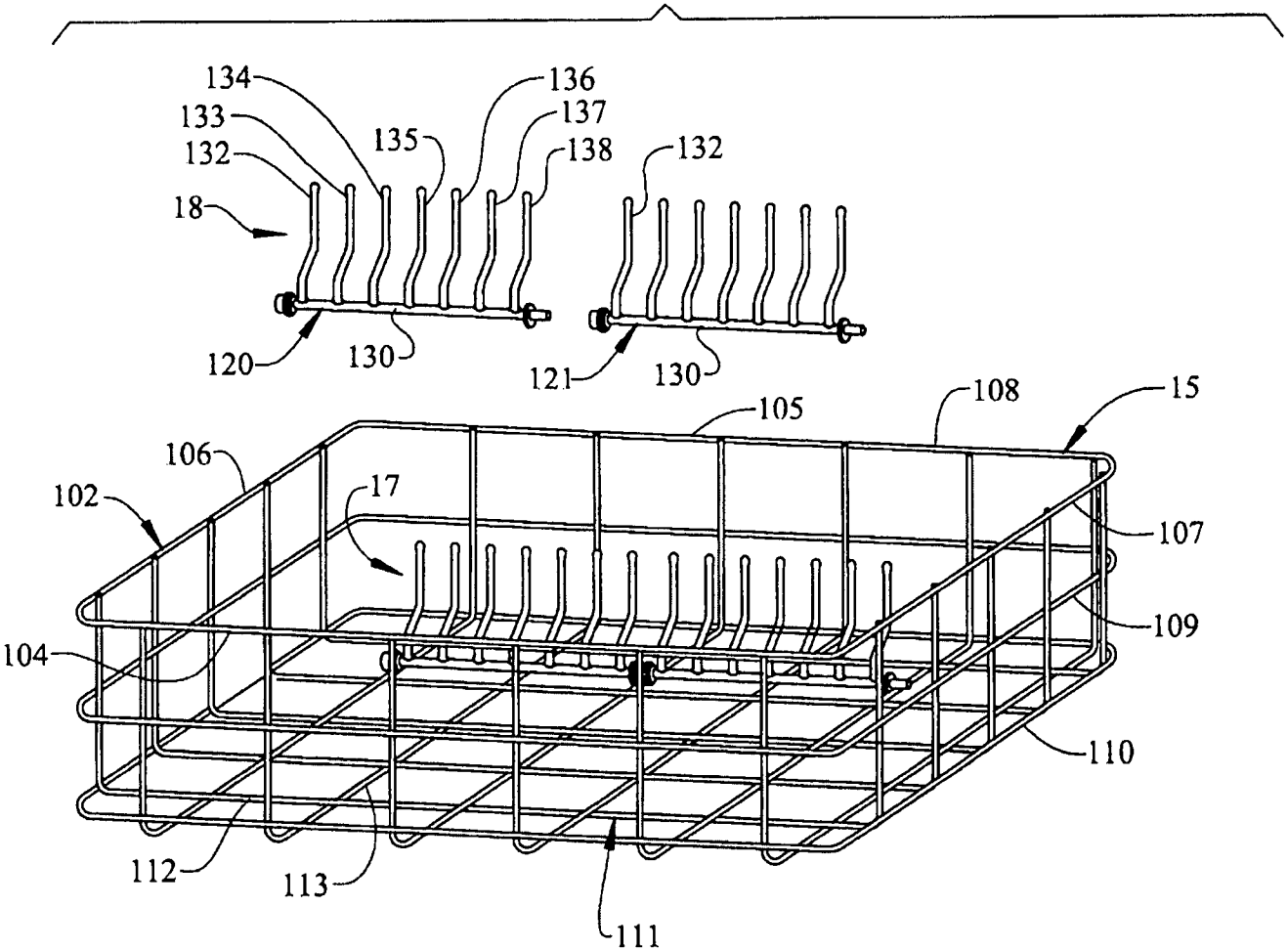
FIG. 2 is a perspective view of the dish support rack of FIG. 1 including tine members constructed in accordance with the present invention.

Reference will now be made to FIG. 2 in describing further details of lower dish support rack 15. As best shown in FIG. 2, lower dish support rack 15 includes an outer frame 102 having front, rear and opposing side walls 104-107 formed from a plurality of wire elements 108-110. Outer frame 102 further includes a bottom wall portion 111. Bottom wall portion 111 is formed from a plurality of wire elements, indicated generally at 112 and 113, that actually interconnect with and are integrated into front and rear walls 104-105 and opposing side walls 106-107 respectively. In general, the structure described above with respect to dishwasher 2 is already known in the art and does not constitute part of the present invention. Therefore, this structure has only been described for the sake of completeness. Instead, the present invention is particularly directed to the formation and construction of tine rows 17 and 18.

Figure 3:
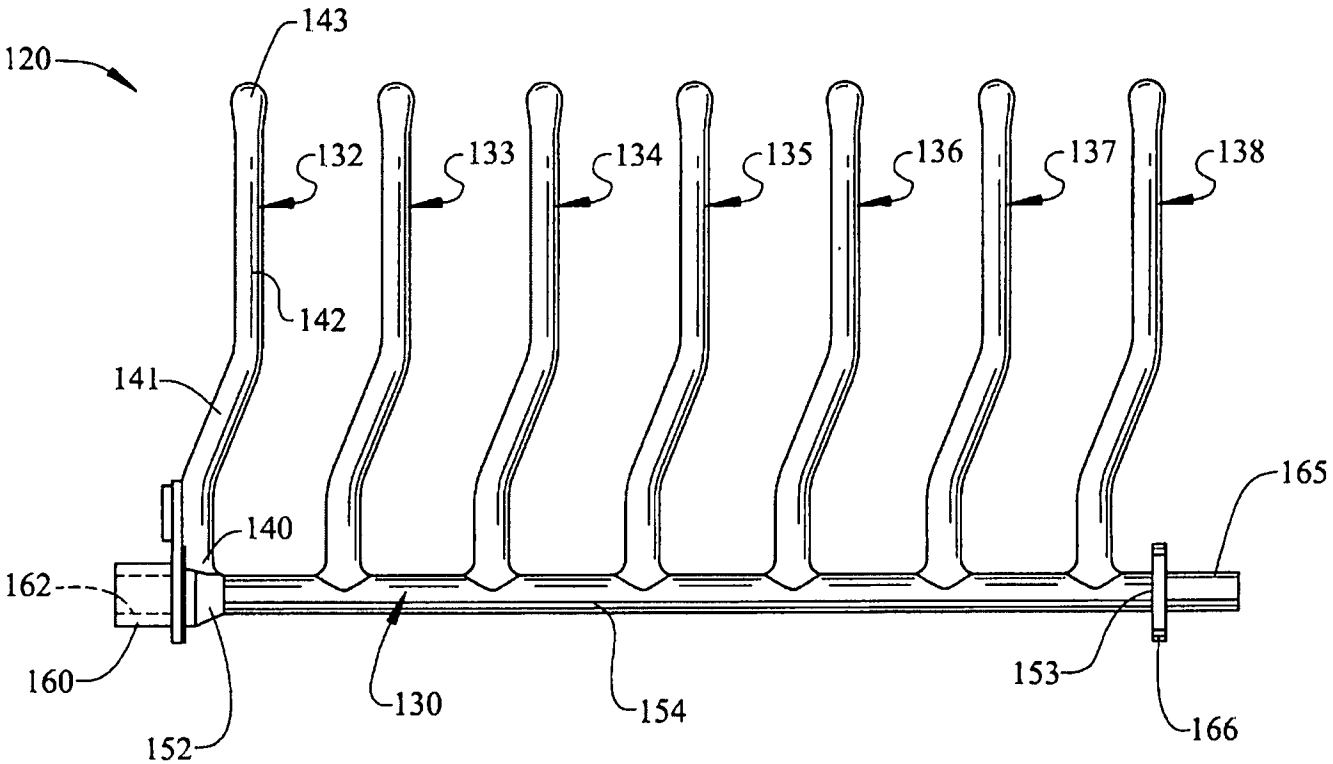
FIG. 3 is an elevational view of a tine member constructed in accordance with a first embodiment of the present invention.

In accordance with a preferred embodiment of the present invention, each tine row 17, 18 is actually formed from a plurality of tine members two of which are indicated at 120 and 121 for tine row 18. Particular reference will now be made to FIG. 3 in describing the specific structure of tine members 120 and 121. However, since the structure of each tine member 120, 121 is identical, a detailed description of tine member 120 will be made and it is to be understood that tine member 121 has commensurate structure.

In the most preferred form of the invention, tine member 120 is formed from plastic. That is, tine member 120 is injection molded from a composite ceramic/plastic material including plastic and ceramic fillers. In one preferred arrangement, the composite ceramic/plastic material includes at least one plastic material such as polyamide, polyphthalamide, polyphenylene sulfide and polyphenylene oxide in an amount ranging from approximately 25% to 65% by weight and at least one ceramic filler such as glass fiber, talc, mica and calcium carbonate in an amount ranging from approximately 35% to 75% by weight. This composition has shown to result in less than 1% mold shrinkage in both flow and transverse directions. In addition, the composite ceramic/plastic material has a heat distortion temperature (HDT) of approximately 400° F. (204.4° C.) at 264 psi. The textured modules of the composition material is about 1,800,000 psi to 3,500,000 psi and a tensile strength of approximately 15,000 psi to 50,000 psi.

In any event, each tine member includes a base member 130 from which project a plurality of tines 132-138. As each tine 132-138 is identical, a detailed description of tine 132 will be made and it is to be understood that tines 133-138 have commensurate structure. As shown, tine 132 includes a first segment 140 that projects, substantially perpendicularly, from base member 130. First segment 140 leads to a second or angled segment 141. Angled segment 141 leads to a third segment 142 that is actually, substantially parallel to but offset from first segment 140. Finally, third segment 142 terminates in a tip member 143. As shown, tine members 132-138 are spaced from each other along base member 130 in a single plane so as to support and separate kitchenware and the like during the washing operation. In particular, a respective pair of tine members 132-138 form tine rows 17 and 18 that can support a plurality of plates, saucers or the like in a spaced relationship (see FIG. 1) which ensures proper exposure to jets of washing fluid during a washing operation.

In further accordance with the most preferred embodiment, base member 130 includes a first end 152 that extends to a second end 153 through an intermediate portion 154. Positioned at first end 152 is a socket element 160 having a central bore or receiver 162. Second end 153 is provided with a pin element 165 which, as will be discussed more fully below, is sized to be snugly received in central bore 162. Pin element 165 terminates in a stop member 166 that is adapted to abut an outer surface (not separately labeled) of socket element 160 and maintain an appropriate special relationship between the plurality of tines 132-138. With this particular construction, tine members 120 and 121, shown exploded in FIG. 2, can be interconnected to form a unified tine row, such as that represented by tine row 17 in FIG. 2, which is then secured to lower dish support rack 15. Preferably, multiple tine rows, e.g., tine rows 17 and 18, are arranged across lower dish support rack 15 to form a dish support zone. More specifically, dish support rack 15 is provided with multiple clips (not shown) that detachably secure tine rows 17, 18 in a variety of configurations that can depend upon particular consumer needs. However, for clarity of the drawings, only tine rows 17 and 18 have been depicted. Most preferably, lower dish support rack 15 includes multiple dish support zones adapted to position and support a wide variety of kitchenware, dishware, glassware and the like in various configurations within dishwasher 2 during a washing operation.

Figure 4:
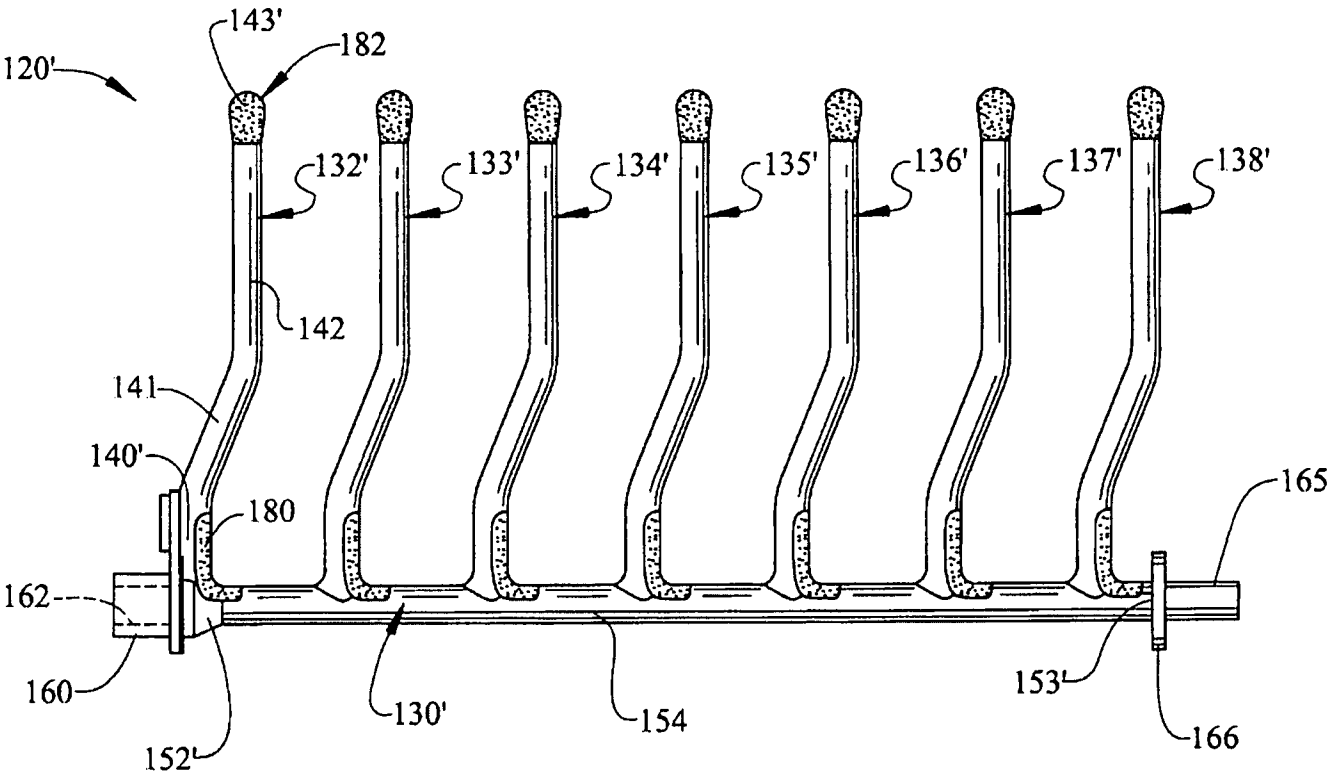
FIG. 4 is an elevational view of a tine member constructed in accordance with a second embodiment of the present invention.

Reference will now be made to FIG. 4 in describing a second embodiment of the present invention wherein like reference numerals represent corresponding parts to that described above. As shown, a tine member 120' includes a base member 130' and a plurality of tines 132'-138'. As each of tines 132'-138' are identical, a description of tine 132' will be made and it is to be understood that tines 133'-138' have commensurate structure. In accordance with the most preferred form of the present embodiment, positioned at an intersection of base member 130' and a first segment 140' of tine 132' is a first elastomeric bumper 180. A second elastomeric bumper 182 is positioned on a tip member 143'. Most preferably, first and second elastomeric bumpers 180 and 182 are over-molded onto tine 132'. That is, after forming tine member 120', tines 132'-138' are over-molded with elastomeric bumpers 180 and 182 at specific dish contact points. Elastomeric bumpers 180 and 182 enhance the gripping or retention capabilities of tines 132'-138' so that dishware and the like are less likely to shift during a typical wash operation, while also protecting the dishware during insertion and removal. In addition, elastomeric bumpers 180 and 182 can add to the overall aesthetics of lower dish support rack 15 by being formed from a variety of colors.

As should be readily apparent from the above description, the present invention provides for a single, cost effective design that will increase the overall versatility of the dish rack. More specifically, the tines can be removed, repositioned or added to create numerous support zones or configurations. That is, in contrast to prior dish rack arrangements, a consumer can now arrange/design a rack to meet his/her particular requirements. Although described with reference to preferred embodiments of the present invention, it should be readily apparent to one of ordinary skill in the art that various changes and/or modifications can be made to the invention without departing from the spirit thereof. For instance, while the elastomeric bumpers are shown in connection with plastic tines, the bumpers could also be over-molded onto rubber coated wire to provide additional protection and increased anti-slip characteristics. Also, while the elastomeric bumpers are shown over-molded onto tines 132'-138', the bumpers could also be added to other dish support structure, such as wine glass holders, cup clips, snugger accessories and the like. Finally, while the tine members of the present invention are shown incorporated into a conventional dishwasher, the present invention can be employed in other applications, such as drawer-type dishwashers. In general, the invention is only intended to be limited to the scope of the following claims.

We claim:

1. A dishwasher comprising:

a tub defining a washing chamber; and a dish support rack arranged within the washing camber, said dish support rack including:

a rack body including front, rear, bottom and opposing side walls, said rack body being adapted to support dishware during a washing operation in the dishwasher;

a plurality of tine members formed from a plastic material and including a base member and a plurality of tines extending from the base member, said plurality of tines establishing dividers for receiving and supporting dishware within the rack body; and a plurality of elastomeric bumpers provided on each of the plurality of tines, wherein the plurality of elastomeric bumpers are over-molded onto each of the plurality of tines, said plurality of elastomeric bumpers providing a cushion for dishware placed in the rack body.

2. The dishwasher according to claim 1, wherein each of the plurality of tines includes a first segment that projects from the base member and a tip portion, said plurality of elastomeric bumpers being provided on the tip portion of each of the plurality of tines.

3. The dishwasher according to claim 2, wherein each of the plurality of tines includes a first segment that projects from the base member and a tip portion, each of said plurality of elastomeric bumpers being provided at an intersection of the first segment and the base member.

4. A dishwasher comprising:

a tub defining a washing chamber; and a dish support rack arranged within the washing chamber, said dish support rack including:

a rack body including front, rear, bottom and opposing side walls, said rack body being adapted to support dishware during a washing operation in the dishwasher;

a plurality of tine members formed from a plastic material and including a base member and a plurality of tines extending from the base member, said plurality of tines establishing dividers for receiving and supporting dishware within the rack body; and a plurality of elastomeric bumpers provided on each of the plurality of tines, said plurality of elastomeric bumpers providing a cushion for dishware places in the rack body, wherein each of the plurality of tines includes a first segment that projects from the base member and a tip portion, said plurality of elastomeric bumpers being provided at both an intersection of the first segment and the base member and the tip portion for each of the plurality of tines.

5. The dishwasher according to claim 4, wherein the plurality of elastomeric bumpers are over-molded onto each of the plurality of tines.

6. The dishwasher according to claim 4, wherein the base member includes a first end having a socket element and a second end provided with a pin element.

7. A dishwasher comprising:

a tub defining a washing chamber; and a dish support rack arranged within the washing camber, said dish support rack including:

a rack body including front, rear, bottom and opposing side walls, said rack body being adapted to support dishware during a washing operation in the dishwasher;

a plurality of tine members formed separate from and attached to the rack body, each of the plurality of tine members being formed from a ceramic and plastic composite material and including a base member and a plurality of tines extending from the base member, said plurality of tines establishing dividers for receiving and supporting dishware within the rack body, wherein the base member includes a first end having a socket element and a second end provided with a pin element.

8. The dishwasher according to claim 7, wherein the plurality of tines are adapted to interconnect, one to the other to form a tine row, with the pin element being received in a respective said socket element.

9. The dishwasher according to claim 7, wherein the plurality of tines are integrally formed with the base member.

10. The dishwasher according to claim 7, wherein the plurality of tines are spaced one from the other along the base member in substantially the same plane.

11. The dishwasher according to claim 7, wherein each of the plurality of tines includes a first section extending from the base member, a second, angled section leading from the first section, and a third section extending from the angled portion and terminating in a tip portion, said third section being substantially parallel to the first section.

12. The dishwasher according to claim 7, wherein the ceramic and plastic composite material includes a plastic material selected from the group consisting of: polyamide, polyphthalamide, polyphenylene sulfide and polyphenylene oxide.

13. The dishwasher according to claim 12, wherein the plastic material is provided in an amount ranging from approximately 25% to 65% by weight.

14. The dishwasher according to claim 7, wherein the ceramic and plastic composite material includes a ceramic material selected from the group consisting of: glass fiber, talc, mica and calcium carbonate.

15. The dishwasher according to claim 14, wherein the ceramic material is provided in an amount ranging from approximately 35% to 75% by weight.

* * * * *